US008194908B2

(12) United States Patent
Akino

(10) Patent No.: US 8,194,908 B2
(45) Date of Patent: Jun. 5, 2012

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1227 days.

(21) Appl. No.: 11/221,875

(22) Filed: Sep. 9, 2005

(65) Prior Publication Data

US 2006/0078148 A1 Apr. 13, 2006

(30) Foreign Application Priority Data

Sep. 30, 2004 (JP) ..... 2004-286280

(51) Int. Cl.
*H04R 9/08* (2006.01)

(52) U.S. Cl. ..... 381/369; 381/174; 381/355

(58) Field of Classification Search ..... 381/174, 381/190, 191, 178, 355, 361, 362, 122, 369, 381/113, 114, 116, 173, 368, 92; 367/181, 367/163, 174

See application file for complete search history.

(56) References Cited

U.S. PATENT DOCUMENTS

| | | | | |
|---|---|---|---|---|
| 5,706,359 | A * | 1/1998 | Chang | 381/361 |
| 2004/0043242 | A1 * | 3/2004 | Nakaoka et al. | 428/553 |

FOREIGN PATENT DOCUMENTS

| | | | |
|---|---|---|---|
| DE | 19742249 | A1 * | 4/1999 |
| JP | U S59-006387 | | 1/1984 |
| JP | H01-209896 | | 8/1989 |
| JP | U H06-77394 | | 10/1994 |
| JP | U 3011048 | | 3/1995 |

* cited by examiner

*Primary Examiner* — Vivian Chin

*Assistant Examiner* — Friedrich W Fahnert

(74) *Attorney, Agent, or Firm* — Manabu Kanesaka

(57) ABSTRACT

In a side-entry condenser microphone, noise is prevented effectively from being generated by electromagnetic waves coming from the outside. In a side-entry condenser microphone including a metallic head case portion 10 which is covered with a metallic guard net 12 at an upper part thereof and is formed into a substantially cylindrical shape in which a microphone unit 13 is arranged via support members 14*a* and 14*b* in an internal space, and a metallic body portion 20 for supporting the head case portion 10 at the upper end thereof, a circuit board 21 mounted with an audio output circuit including an impedance converter is fitted in a lower opening of the head case portion 10 supported on the body portion 20 so as to close the lower opening with the circuit mounting surface 21*a* of the circuit board 21 being on the case inner surface side. Thereby, an electrostatic shield is completed by the head case portion 10 only.

3 Claims, 4 Drawing Sheets

CONDENSER MICROPHONE

TECHNICAL FIELD

The present invention relates to a condenser microphone. More particularly, it relates to a technique for protecting a side-entry condenser microphone used exclusively at a studio from electromagnetic waves coming from the outside.

BACKGROUND ART

In a condenser microphone, since the impedance of a microphone unit thereof is very high, an impedance converter such as a field effect transistor (FET) and a vacuum tube is used. If strong electromagnetic waves are applied from the outside, they are detected by the impedance converter, and hence noise sometimes occurs on an audio frequency band.

In recent years, cellular phones have come into wide use rapidly. At the time of transmission of cellular phone, very strong electromagnetic waves are radiated, so that countermeasures against electromagnetic waves have been required even in the side-entry condenser microphone used exclusively at a studio. FIGS. 3A and 3B are a front longitudinal sectional view and a side longitudinal sectional view of a side-entry condenser microphone, respectively. FIG. 4 is an exploded view of FIG. 3A.

Referring to these figures, the side-entry condenser microphone is broadly divided, in terms of structure, into a head case portion 10, a body portion 20 for supporting the head case portion 10 on the upper end side, and a connector portion 30 mounted on the lower end side of the body portion 20.

The head case portion 10 has a base ring 11 formed of a metallic material such as brass, and an upper part thereof is covered with a metallic guard net 12. Usually, a wind screen 12*a* formed of a permeable sheet material is additionally provided on the inner surface of the guard net 12.

In an internal space surrounded by the guard net 12, a microphone unit 13 is arranged in a state of being supported on the base ring 11 via a support bracket 14*a* and a shock mount material 14*b* having rubber elasticity. Since this microphone is of a side entry type, the sound-capturing axis of the microphone unit 13 is in a substantially horizontal direction.

The body portion 20 is formed into a cylindrical shape also using a metallic material such as brass, and a circuit board 21 is installed therein via stays 22. Although not shown in the figures, the circuit board 21 is mounted with an audio output circuit including the impedance converter, a polarization voltage generating circuit, and the like.

The connector portion 30 has a connector cover 31 integrally having a cylindrical portion 32 also formed of a metallic material such as brass, and an output connector 33 is arranged in the cylindrical portion 32. Usually, as the output connector 33, an output connector of three-pin type connected to a phantom power source via a balanced shield cable, not shown, is used.

After the microphone unit 13 and the circuit board 21, and the circuit board 21 and the output connector 33 are connected to each other by respective wiring, not shown, the head case portion 10, the body portion 20, and the connector portion 30 are connected integrally with machine screws, not shown.

Since the head case portion 10, the body portion 20, and the connector portion 30 are each formed of a metallic material, a shield case is formed by these members. However, the electrical connection between these members is due to mechanical point contact, so that the point contact portion has an impedance in terms of high frequency.

Thereupon, the conventional example has a problem in that strong electromagnetic waves generated by a cellular phone etc. intrude from the point contact portion (connecting portion of these members) having an impedance in terms of high frequency into the microphone, whereby noise is generated easily.

SUMMARY OF THE INVENTION

Accordingly, an object of the present invention is to effectively prevent noise from being generated by electromagnetic waves coming from the outside in a side-entry condenser microphone including a head case portion, a body portion, and a connector portion, which are connected integrally.

To achieve the above object, the present invention provides a condenser microphone configured so that in a side-entry condenser microphone including a metallic head case portion which is covered with a metallic guard net at an upper part thereof and is formed into a substantially cylindrical shape in which a microphone unit is arranged via a support member in an internal space, and a metallic body portion for supporting the head case portion at the upper end thereof, a circuit board mounted with an audio output circuit including an impedance converter is fitted in a lower opening of the head case portion supported on the body portion so as to close the lower opening with the circuit mounting surface of the circuit board being on the case inner surface side.

According to this configuration, the lower opening of the head case portion is closed by the circuit board, and an electrostatic shield is completed by the head case portion only. Therefore, even if electromagnetic waves intrude from a connecting portion between the head case portion and the body portion, they are not detected by the impedance converter. Thereby, noise is prevented effectively from being generated by electromagnetic waves coming from the outside.

Besides, a performance inspection as a microphone can be carried out at the stage of assembly of the head case portion, so that quality variations caused by the compatibility between, for example, the microphone unit and a circuit can be lessened. Also, a defective component can be repaired at an early stage in the manufacturing process.

Also, it is preferable that a ground pattern of the circuit board be connected electrically to the head case portion, and further it is preferable that an allover pattern consisting of copper foil be formed over the whole back surface on the opposite side to the circuit mounting surface of the circuit board.

Also, by connecting the ground pattern of the circuit board electrically to the head case portion, or by forming the allover pattern consisting of copper foil over the whole back surface on the opposite side to the circuit mounting surface of the circuit board, the completion of electrostatic shield can further be enhanced by the head case portion only.

DETAILED DESCRIPTION

Figure 1A:
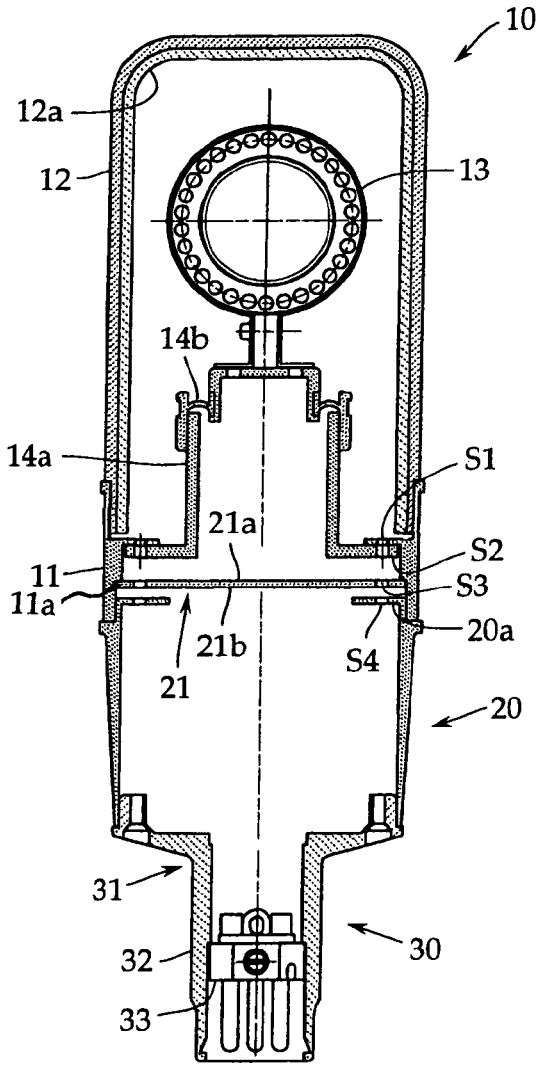
FIG. 1A is a front longitudinal sectional view showing one example of a side-entry condenser microphone in accordance with the present invention.
Figure 1B:
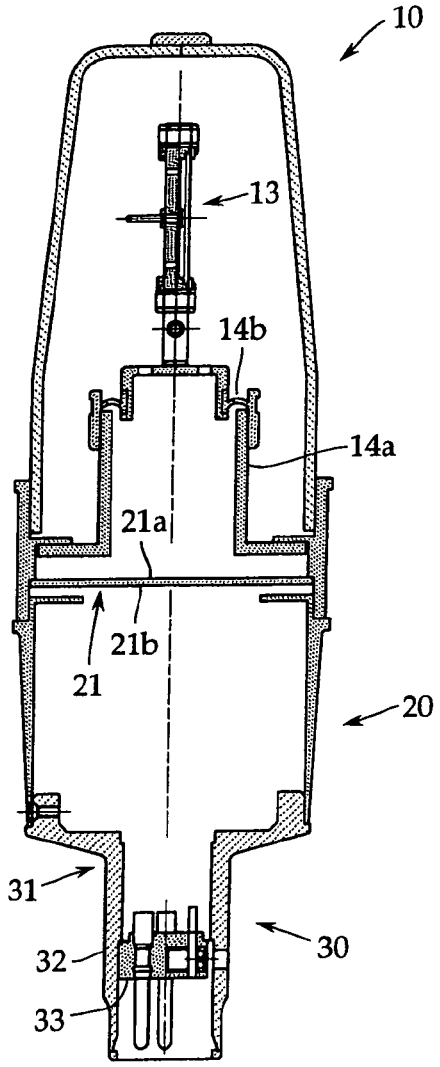
FIG. 1B is a side longitudinal sectional view showing one example of a side-entry condenser microphone in accordance with the present invention.
Figure 2A:
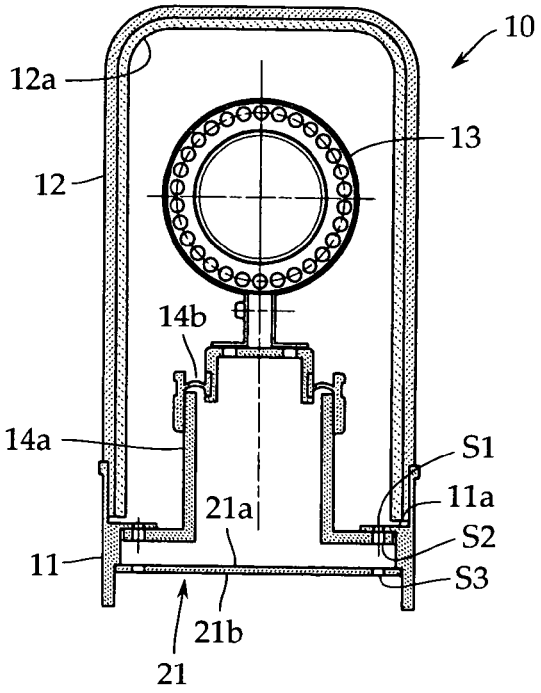
FIG. 2A is a front longitudinal sectional view of a head case portion, which is an essential portion of the present invention.
Figure 2B:
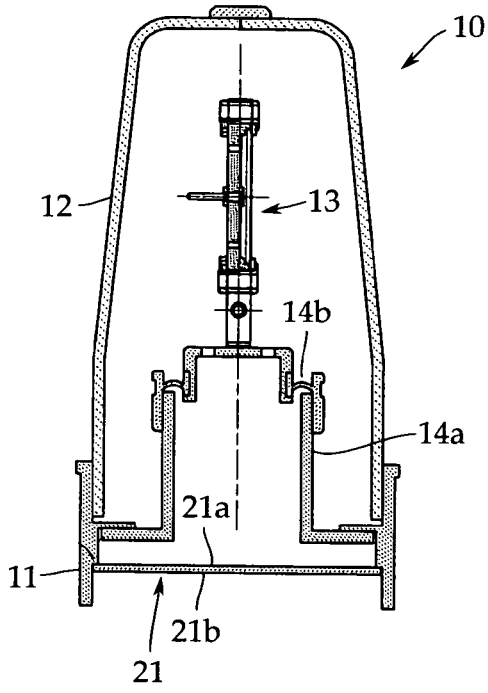
FIG. 2B is a side longitudinal sectional view of a head case portion.
Figure 3A:
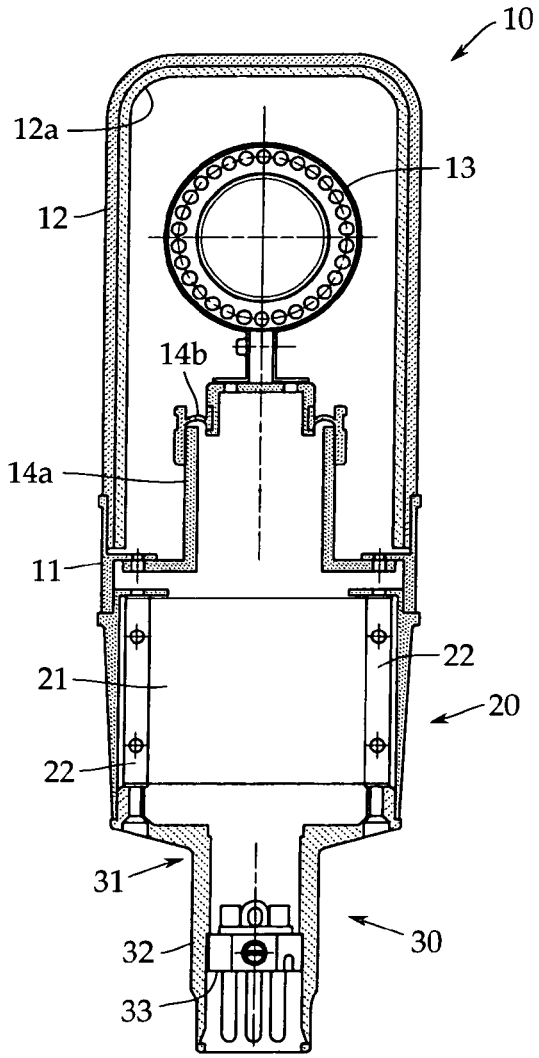
FIG. 3A (PRIOR ART)
FIG. 3A is a front longitudinal sectional view of a conventional side-entry condenser microphone.
Figure 3B:
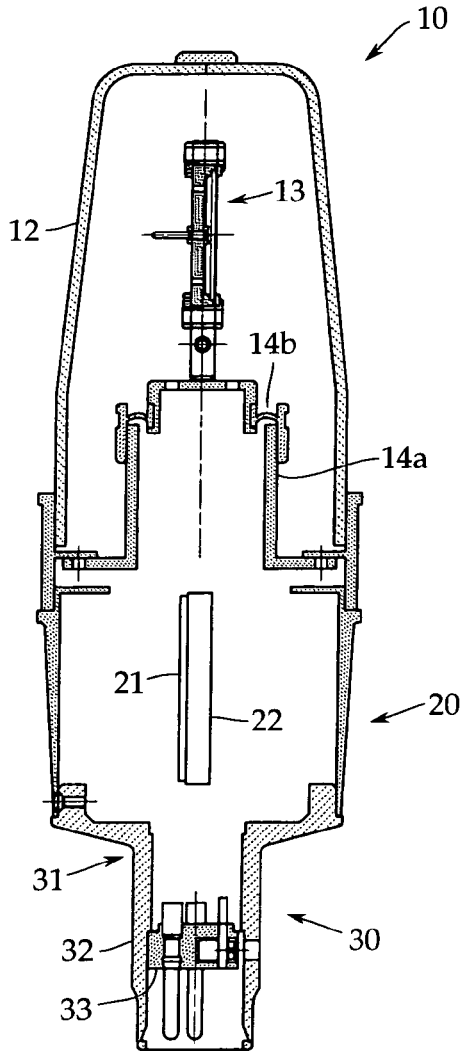
FIG. 3B (PRIOR ART)
FIG. 3B is a side longitudinal sectional view of a conventional side-entry condenser microphone.
Figure 4:
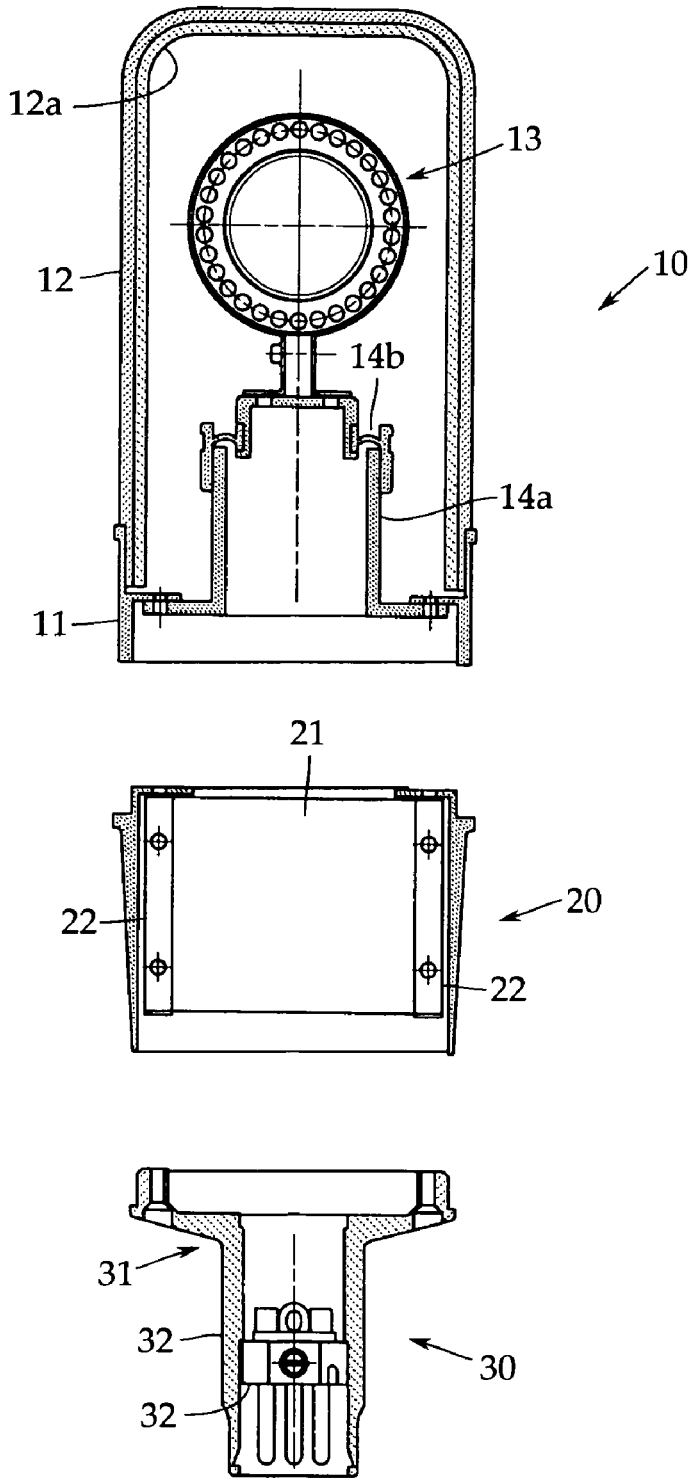
FIG. 4 (PRIOR ART)
FIG. 4 is an exploded view of FIG. 3A.

An embodiment of the present invention will now be described with reference to FIGS. 1 and 2. The present invention is not limited to this embodiment. FIGS. 1A and 1B are a front longitudinal sectional view and a side longitudinal sectional view showing one example of a side-entry condenser microphone in accordance with the present invention, respectively. FIGS. 2A and 2B are a front longitudinal sectional view and a side longitudinal sectional view of a head case portion, which is an essential portion of the present invention, respectively. The same reference characters are applied to elements that need not be changed from the conventional example explained with reference to FIGS. 3 and 4.

Like the conventional example explained before, the side-entry condenser microphone of this embodiment also includes a head case portion 10, a body portion 20 for supporting the head case portion 10 at the upper end thereof, and a connector portion 30 mounted at the lower end of the body portion 20.

The head case portion 10 has a base ring 11 formed of a metallic material such as brass, and an upper part thereof is covered with a metallic guard net 12. As the guard net 12, a guard net having a mesh which electromagnetic waves do not penetrate is used. On the inner surface of the guard net 12, a wind screen 12*a* formed of a permeable sheet material is preferably provided along the inner surface.

In an internal space surrounded by the guard net 12, a microphone unit 13 is arranged in a state of being supported on the base ring 11 via a support bracket 14*a* and a shock mount material 14*b* having rubber elasticity. Since this microphone is of a side entry type, the sound-capturing axis of the microphone unit 13 is in a substantially horizontal direction.

Although a unidirectional unit is used as the microphone unit 13 in this example, the microphone unit 13 may be a variable directional unit, for example. Also, the support bracket 14*a* and the shock mount material 14*b* may have any configuration if they can surely support the microphone unit 13 by absorbing mechanical vibrations coming from the outside.

According to the present invention, a lower opening of the head case portion 10 is closed by a circuit board 21 for the microphone unit 13. Although not shown in the figures, the circuit board 21 is mounted with an audio output circuit including an impedance converter, a polarization voltage generating circuit, and the like.

If a circuit mounting surface of the circuit board 21 is denoted by reference character 21*a*, and the back surface thereof is denoted by reference character 21*b*, the circuit board 21 is fitted in the base ring 11 with the circuit mounting surface 21*a* being on the inner surface side of the head case portion 10. On the inner peripheral surface of the base ring 11, a step portion 11*a* engaging with the circumferential edge of the circuit board 21 is formed to position the circuit board 21.

Although not shown in the figures, at the circumferential edge on the circuit mounting surface 21*a* side, a part of a ground pattern of the circuit board 21 is pulled out, so that when the circuit board 21 is fitted in the base ring 11, the ground pattern comes into electrical contact with the base ring 11 in the step portion 11*a*.

By closing the lower opening of the head case portion 10 by the circuit board 21 in this manner, an electrostatic shield of the head case portion only is completed. In order to enhance the completion of the electrostatic shield, it is preferable that an allover pattern of copper foil be formed over the whole surface of the back surface 21*b* of the circuit board 21, and the allover pattern be connected to the ground pattern on the circuit mounting surface 21*a* side via wiring in a through hole.

The body portion 20 is formed into a cylindrical shape using a metallic material such as brass. In this embodiment, since the circuit board 21 is shifted to the head case portion 10 side, the interior of the body portion 20 is kept hollow. The connector portion 30 may have the same configuration as that of the conventional example explained before. However, since the body portion 20 contains nothing, the connector portion 30 may be integral with the body portion 20.

In this example, the support bracket 14*a*, the circuit board 21, and the body portion 20 are tightened together by common screws with respect to the base ring 11 of the head case portion 10. Specifically, as shown in FIG. 1A, an internally threaded hole S1 is formed in an internal flange 11*a* of the base ring 11, and screw insertion holes S2 to S4 are coaxially formed in a leg portion of the support bracket 14*a*, at the circumferential edge of the circuit board 21, and an internal flange 20*a* of the body portion 20, respectively. Thereby, a male screw, not shown, is threadedly mounted in the internally threaded hole S1 from the body portion 20 side, by which these members are tightened together.

In the case of this example as well, a connecting portion between the head case portion 10 and the body portion 20 and a connecting portion between the body portion 20 and the connector portion 30 have an impedance in terms of high frequency, so that strong electromagnetic waves generated by a cellular phone etc. sometimes intrude from these connecting portions into the microphone. However, even if the electromagnetic waves intrude into the microphone, since the head case portion 10 is shielded by the circuit board 21, the electromagnetic waves are not detected by the impedance converter, and therefore the generation of noise due to electromagnetic waves is prevented.

Also, a performance inspection as a microphone can be carried out at the stage of assembly of the head case portion 10, so that quality variations caused by the compatibility between, for example, the microphone unit 13 and a component mounted on the circuit board 21 can be lessened. Also, a defective component can be repaired at an early stage in the manufacturing process.

The present application is based on, and claims priority from, Japanese Application Serial Number JP2004-286280, filed Sep. 30, 2004, the disclosure of which is hereby incorporated by reference herein in its entirety.

The invention claimed is:

1. A side-entry condenser microphone, comprising:

a metallic head case portion having a metallic guard net, and a metallic base ring situated at one side of the metallic guard net and having a step portion and an opening, a microphone unit disposed in an internal space of the head case portion to pick up sound through the metallic guard net, a support member attached to the microphone unit to dispose the microphone unit in the internal space along a longitudinal direction of the head case, a metallic body portion attached under the support member, for supporting the head case portion at an upper end thereof, and a circuit board having an audio output circuit with an impedance converter on one side, said circuit board being arranged substantially perpendicularly to the longitudinal direction of the head case, and fitted in the opening of the base ring so that the opening is closed by the circuit board with the audio output circuit facing an inside of the head case portion, wherein the circuit board has a ground pattern connected electrically to the head case portion so that an electro static shield space is formed in the head case portion, wherein the circuit board includes an allover pattern formed of copper foil over a whole back surface on a side opposite to a circuit mounting surface, and wherein the step portion engages a circumferential edge of the circuit board to position the circuit board with respect to the head case portion and establish an electrical connection between the base ring and the allover pattern.

2. The condenser microphone according to claim 1, wherein the base ring supports the metallic guard net, and the support member is connected to the body portion.

3. The condenser microphone according to claim 1, further comprising a connector portion attached to the metallic body at a side opposite to the head case, said circuit board being retained in the opening of the base ring between the guard net and the connector portion.

* * * * *